US009334674B1

(12) United States Patent
Churnick

(10) Patent No.: US 9,334,674 B1
(45) Date of Patent: May 10, 2016

(54) FENCE BUILDING ASSEMBLY

(71) Applicant: Ronald A. Churnick, Rochelle, VA (US)

(72) Inventor: Ronald A. Churnick, Rochelle, VA (US)

( * ) Notice: Subject to any disclaimer, the term of this patent is extended or adjusted under 35 U.S.C. 154(b) by 111 days.

(21) Appl. No.: 14/340,879

(22) Filed: Jul. 25, 2014

(51) Int. Cl.
*E04H 17/26* (2006.01)

(52) U.S. Cl.
CPC ..... *E04H 17/26* (2013.01); *E04H 17/261* (2013.01)

(58) Field of Classification Search
CPC ..... E04H 17/00; E04H 17/26; E04H 17/261; E04H 17/263
See application file for complete search history.

(56) References Cited

U.S. PATENT DOCUMENTS 2,466,919 A * 4/1949 Sykes ..... E04F 21/1883 269/1
3,201,874 A * 8/1965 Christy ..... E04C 3/02 269/43
4,420,921 A * 12/1983 Hardin ..... E04F 21/00 269/43
4,583,278 A * 4/1986 Flores ..... B25B 11/02 29/281.5
4,625,415 A * 12/1986 Diamontis ..... E04G 21/1891 33/562
4,930,225 A 6/1990 Phillips
5,163,233 A * 11/1992 Benson ..... E04G 21/1841 269/904
5,491,905 A * 2/1996 Jablonski ..... E04G 21/1891 33/481
5,628,119 A * 5/1997 Bingham ..... E04G 21/1891 269/904
5,673,903 A 10/1997 Lewis
6,293,028 B1 * 9/2001 Sylvia ..... E04G 21/1891 33/416
7,377,489 B1 5/2008 Houseman
7,726,037 B1 * 6/2010 Jordan ..... E04H 17/20 33/613
D626,814 S 11/2010 Grondin
8,601,705 B2 * 12/2013 Bierman ..... G01B 3/30 33/613
2002/0095813 A1 * 7/2002 Tatarnic ..... G01C 15/02 33/613
2006/0010703 A1 * 1/2006 Gauthier ..... E04G 21/1891 33/613

* cited by examiner

*Primary Examiner* — Lee D Wilson
*Assistant Examiner* — Tyrone V Hall, Jr.

(57) ABSTRACT

A fence building assembly allows a person to build a fence without outside assistance. The assembly includes a main bar and a pair of support rods coupled to and extending from the main bar. A lower end of each of the support rods defines a slot. A gripping rod is coupled to the main bar. A guide member comprises a straight portion and a pair of flange portion. Each of the flange portions is coupled to and extends outwardly from opposite ends of the straight portion. The flange portions are parallel with respect to each other. One of the flange portions is configured to abut a top end of a top rail board and one of the flange portions is configured to abut a bottom end of a bottom rail board wherein the guide member is configured to align the top and bottom rail boards with respect to each other.

18 Claims, 6 Drawing Sheets

FENCE BUILDING ASSEMBLY

BACKGROUND OF THE DISCLOSURE

Field of the Disclosure

The disclosure relates to fence installation devices and more particularly pertains to a new fence installation device for allowing a person to build a fence without assistance from another.

SUMMARY OF THE DISCLOSURE

An embodiment of the disclosure meets the needs presented above by generally comprising a main bar and a pair of support rods coupled to and extending from the main bar. A lower end of each of the support rods defines a slot. A gripping rod is coupled to the main bar. A guide member comprises a straight portion and a pair of flange portion. Each of the flange portions is coupled to and extends outwardly from opposite ends of the straight portion. The flange portions are parallel with respect to each other. One of the flange portions is configured to abut a top end of a top rail board and one of the flange portions is configured to abut a bottom end of a bottom rail board wherein the guide member is configured to align the top and bottom rail boards with respect to each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
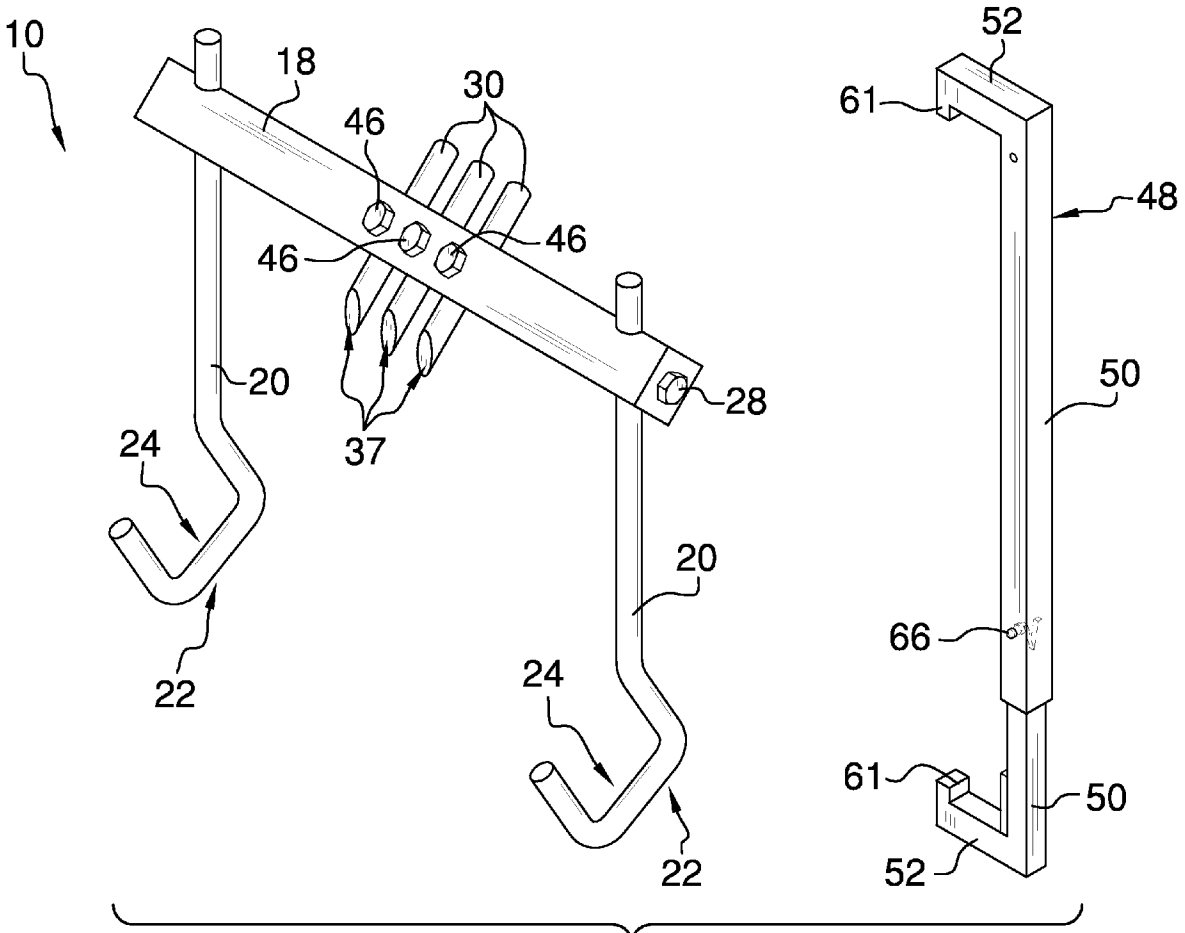
FIG. 1 is a top front side perspective view of a fence building assembly according to an embodiment of the disclosure.
Figure 2:
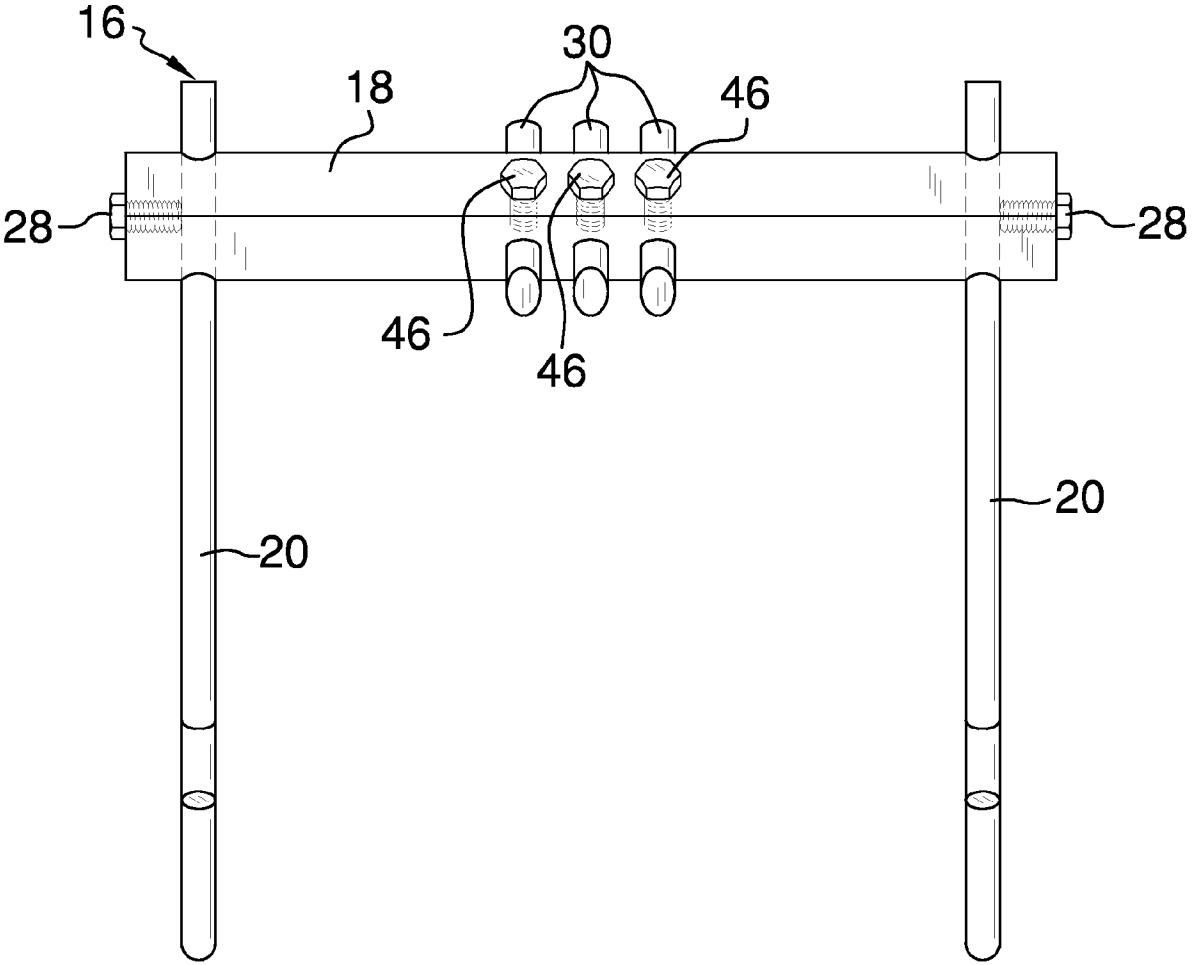
FIG. 2 is a front view of a support member of an embodiment of the disclosure.
Figure 3:
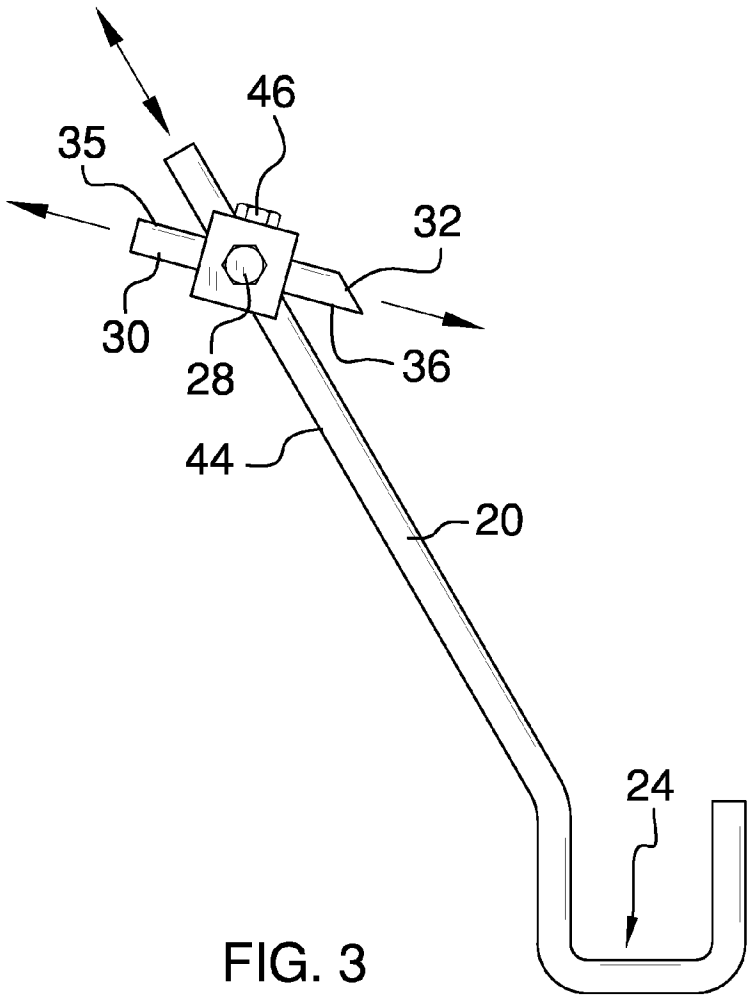
FIG. 3 is a side view of a support member an embodiment of the disclosure.
Figure 4:
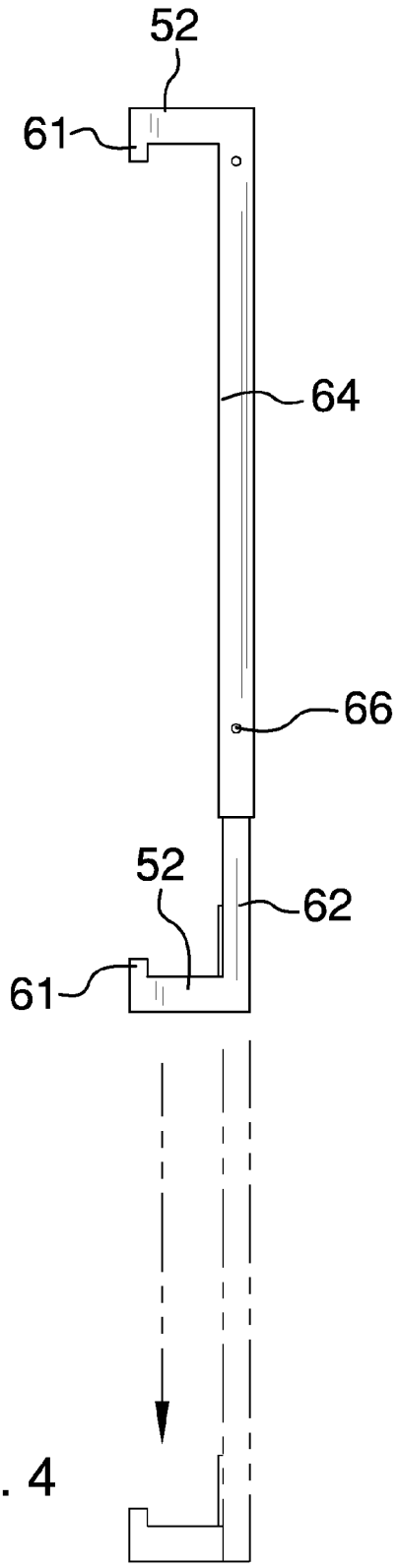
FIG. 4 is a side view of a guide member of an embodiment of the disclosure.
Figure 5:
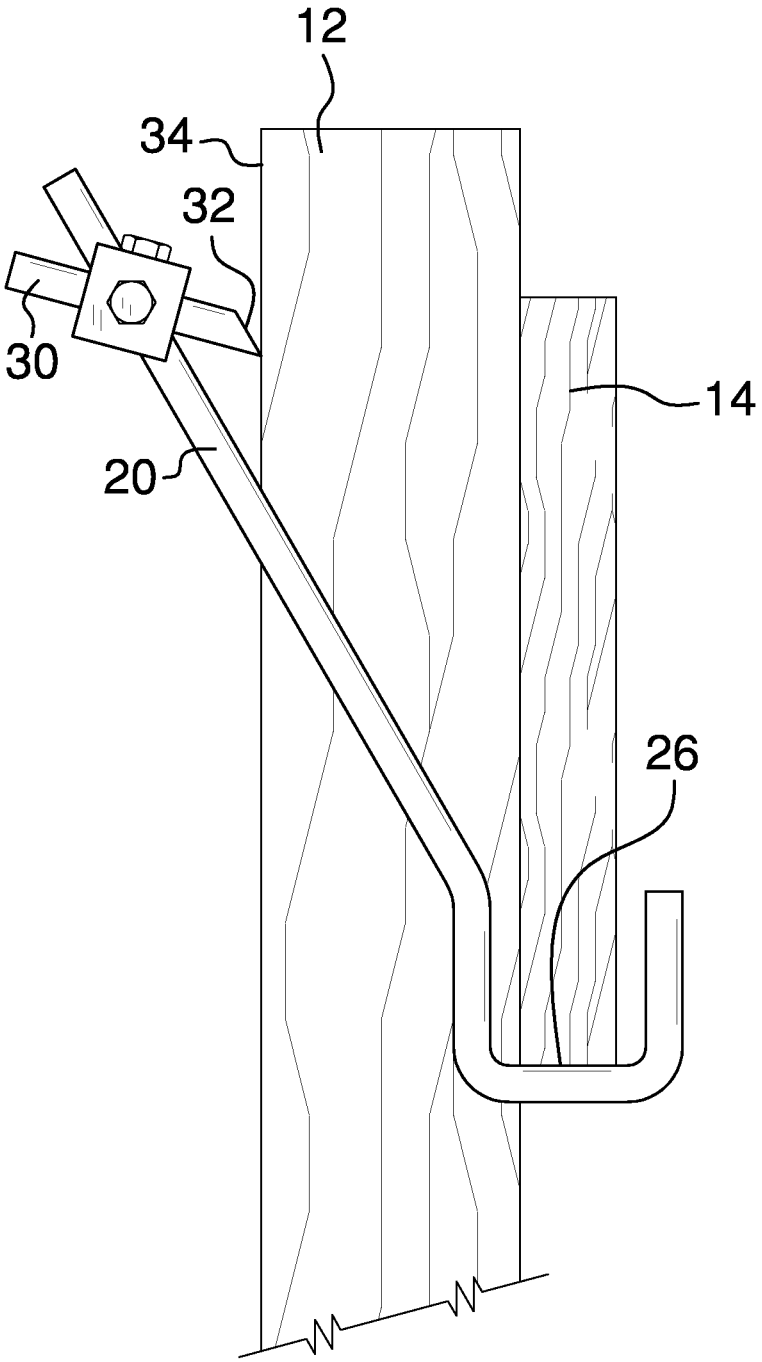
FIG. 5 is an in-use side view of a support member of an embodiment of the disclosure.
Figure 6:
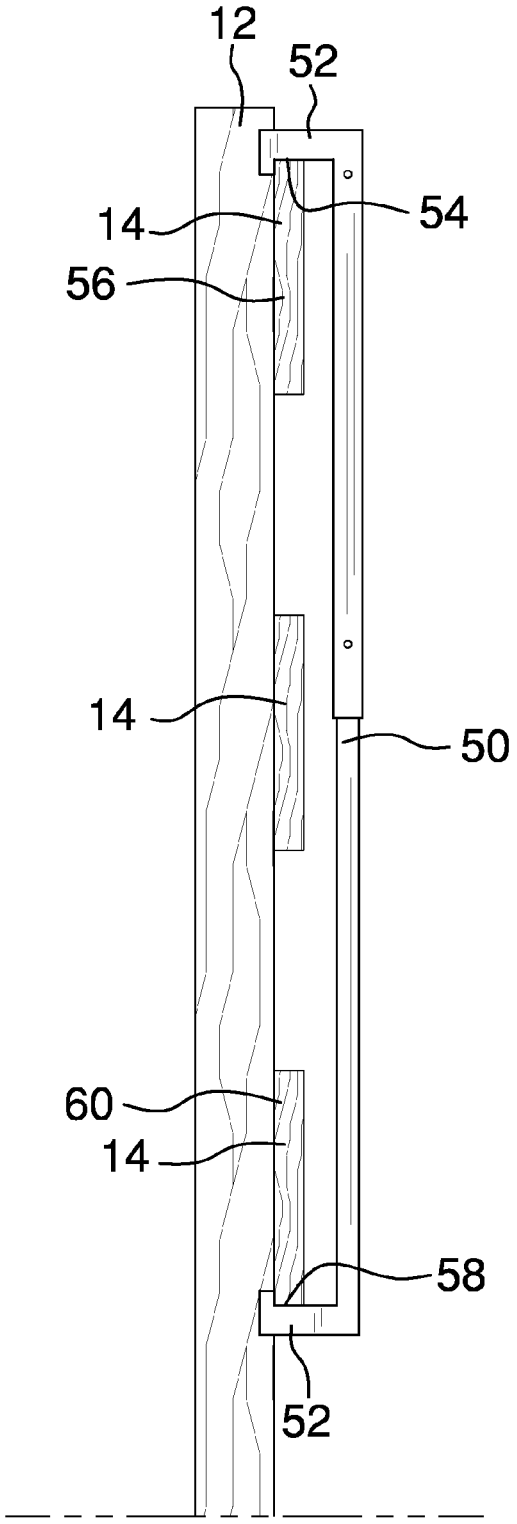
FIG. 6 is an in-use side view of a guide member of an embodiment of the disclosure.

With reference now to the drawings, and in particular to FIGS. 1 through 6 thereof, a new fence installation device embodying the principles and concepts of an embodiment of the disclosure and generally designated by the reference numeral 10 will be described.

As best illustrated in FIGS. 1 through 6, the fence building assembly 10 is used for building a conventional picket-style fence having vertical posts 12 and horizontal rail boards 14 coupled to and extending between the vertical posts 12. The assembly 10 generally comprises a support member 16 including a main bar 18. A pair of support rods 20 is coupled to and extends from the main bar 18. A lower end 22 of each of the support rods 20 defines a slot 24 wherein each slot 24 is configured to receive a bottom end 26 of a rail board 14 therein. Each of the support rods 20 is slidably coupled to the main bar 18. A pair of fasteners 28 extends into the main bar 18. Each of the fasteners 28 threadably engages an associated one of the support rods 20 to secure the support rods 20 in a selectable position relative to the main bar 18.

A gripping rod 30 is coupled to the main bar 18. A front end 32 of the gripping rod 30 is configured to abut a rear surface 34 of one of the vertical posts 12. The gripping rod 30 may be one of a plurality of gripping rods 30. Each of the gripping rods 30 is spaced and horizontally aligned relative to each other on the main bar 18. The front end 32 of each of the gripping rods 30 is angled such that the front end 32 tapers outwardly from a top 35 to a bottom 36 of the gripping rod 30. The front end 32 of each of the gripping rods 30 includes a planar face 37. The gripping rods 30 are centered on the main bar 18. Each of the gripping rods 30 is slidably coupled to the main bar 18. Each of the gripping rods 30 extends through the main bar 18. In particular, each of the gripping rods 30 extends through a front side 40 and a rear side 42 of the main bar 18. The top 35 of each of the gripping rods 30 is positioned at an acute angle relative to a rear surface 44 of each of the support rods 20. A plurality of couplers 46 extends into the main bar 18. Each of the couplers 46 threadably engages an associated one of the gripping rods 30 to secure the gripping rods 30 in a selectable position relative to the main bar 18.

A guide member 48 comprises a straight portion 50 and a pair of flange portions 52. Each of the flange portions 52 is coupled to and extends outwardly from opposite ends of the straight portion 50. The flange portions 52 are parallel with respect to each other. One of the flange portions 52 is configured to abut a top end 54 of a top one 56 of the rail boards 14 and one of the flange portions 52 is configured to abut a bottom end 58 of a bottom one 60 of the rail boards 14 wherein the guide member 48 is configured to align the top one 56 and the bottom one 60 of the rail boards 14 so that they are parallel with respect to each other. Each of the flange portions 52 has a downward projection 61 positioned distally relative to the straight portion 50. The downward projections 61 extend toward each other.

The guide member 48 includes a first tubular section 62 and a second tubular section 64. The first tubular section 62 is slidably positioned within the second tubular section 64. A button 66 is coupled to the guide member 48. The button 66 extends into the second tubular section 64 such that depression of the button 66 permits sliding of the first 62 and second 64 tubular sections relative to each other. The button 66 is generally conventional and includes a biasing member to bias the button 66 outwardly of the second tubular section 64 for selectively locking the first 62 and second 64 tubular sections relative to each other.

In use, as stated above and shown in the Figures, the support member 16 is positioned against a vertical post 12 such that the front end 32 of the gripping rods 30 abuts the rear surface 34 of the vertical post 12 and retains the gripping rods 30 in position against the rear surface 34 of the vertical post 12. A top one 56 of the rail boards 14 is positioned in each of the slots 24 such that the bottom ends 26 of the rail boards 14 are received within the slots 24. The top one 56 of the rail boards 14 is then nailed to the vertical post 12 and to adjacently positioned ones of the vertical posts 12. The guide member 48 is then hung from the top one 56 of the rail boards 14 and used to support an additional one of the rail boards 14 below the top one 56 of the rail boards 14. The additional one of the rail boards 14 can then be nailed into the vertical posts 12. In this manner, the assembly 10 holds the rail boards 14 and allows the rail boards 14 to align in parallel with each other so that a single person can build a picket-style fence without assistance from others. The process can be repeated until as many rail boards 14 are installed per vertical post 12 as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A fence building assembly for building a picket-style fence having vertical posts and horizontal rail boards coupled to and extending between the vertical posts, said assembly comprising:

a main bar;

a pair of support rods coupled to and extending from said main bar, a lower end of each of said support rods defining a slot wherein each said slot is configured to receive a bottom end of a rail board therein;

a gripping rod coupled to said main bar, said gripping rod being configured to abut a rear surface of one of the vertical posts; and a guide member comprising a straight portion and a pair of flange portions, each of said flange portions being coupled to and extending outwardly from opposite ends of said straight portion, said flange portions being parallel with respect to each other, one of said flange portions being configured to abut a top end of a top one of the rail boards and one of said flange portions being configured to abut a bottom end of a bottom one of the rail boards wherein said guide member is configured to align the top one and the bottom one of the rail boards with respect to each other.

2. The assembly of claim 1, further comprising said gripping rod being one of a plurality of said gripping rods, each of said gripping rods being spaced and horizontally aligned relative to each other on said main bar.

3. The assembly of claim 2, further comprising a front end of each of said gripping rods being angled such that said front end tapers outwardly from a top to a bottom of said gripping rod.

4. The assembly of claim 2, further comprising said gripping rods being centered on said main bar.

5. The assembly of claim 2, further comprising each of said gripping rods being slidably coupled to said main bar.

6. The assembly of claim 5, further comprising a plurality of couplers extending into said main bar, each of said couplers threadably engaging an associated one of said gripping rods to secure said gripping rods in a selectable position relative to said main bar.

7. The assembly of claim 2, further comprising each of said gripping rods extending through said main bar.

8. The assembly of claim 7, further comprising each of said gripping rods extending through a front side and a rear side of said main bar.

9. The assembly of claim 2, further comprising a front end of each of said gripping rods including a planar face.

10. The assembly of claim 1, further comprising said support rods extending through said main bar.

11. The assembly of claim 10, further comprising said support rods extending through a juncture between a front side and a top side of said main bar and a juncture between a rear side and a bottom side of said main bar.

12. The assembly of claim 10, further comprising a top of each of said gripping rods being positioned at an acute angle relative to a rear surface of each of said support rods.

13. The assembly of claim 1, further comprising each of said support rods being slidably coupled to said main bar.

14. The assembly of claim 13, further comprising a pair of fasteners extending into said main bar, each of said fasteners threadably engaging an associated one of said support rods to secure said support rods in a selectable position relative to said main bar.

15. The assembly of claim 1, further comprising said guide member including a first tubular section and a second tubular section, said first tubular section being slidably positioned within said second tubular section.

16. The assembly of claim 15, further comprising a button coupled to said guide member, said button extending into said second tubular section such that depression of said button permits sliding of said first and second tubular sections relative to each other.

17. The assembly of claim 1, further comprising each of said flange portions having a downward projection positioned distally relative to said straight portion, said downward projections extending toward each other.

18. A fence building assembly for building a picket-style fence having vertical posts and horizontal rail boards coupled to and extending between the vertical posts, said assembly comprising:

a main bar;

a pair of support rods coupled to and extending from said main bar, a lower end of each of said support rods defining a slot wherein each said slot is configured to receive a bottom end of a rail board therein, each of said support rods being slidably coupled to said main bar;

a pair of fasteners extending into said main bar, each of said fasteners threadably engaging an associated one of said support rods to secure said support rods in a selectable position relative to said main bar;

a gripping rod coupled to said main bar, a front end of said gripping rod being configured to abut a rear surface of one of the vertical posts, said gripping rod being one of a plurality of said gripping rods, each of said gripping rods being spaced and horizontally aligned relative to each other on said main bar, said front end of each of said gripping rods being angled such that said front end tapers outwardly from a top to a bottom of said gripping rod, said gripping rods being centered on said main bar, said front end of each of said gripping rods including a planar face, each of said gripping rods being slidably coupled to said main bar, each of said gripping rods extending through said main bar, each of said gripping rods extending through a front side and a rear side of said main bar, a top of each of said gripping rods being positioned at an acute angle relative to a rear surface of each of said support rods;

a plurality of couplers extending into said main bar, each of said couplers threadably engaging an associated one of said gripping rods to secure said gripping rods in a selectable position relative to said main bar;

a guide member comprising a straight portion and a pair of flange portions, each of said flange portions being coupled to and extending outwardly from opposite ends of said straight portion, said flange portions being parallel with respect to each other, one of said flange portions being configured to abut a top end of a top one of the rail boards and one of said flange portions being configured to abut a bottom end of a bottom one of the rail boards wherein said guide member is configured to align the top one and the bottom one of the rail boards with respect to each other, each of said flange portions having a downward projection positioned distally relative to said straight portion, said downward projections extending toward each other, said guide member including a first tubular section and a second tubular section, said first tubular section being slidably positioned within said second tubular section; and a button coupled to said guide member, said button extending into said second tubular section such that depression of said button permits sliding of said first and second tubular sections relative to each other.

* * * * *